US005195472A

United States Patent [19]

Jacques et al.

[11] Patent Number: 5,195,472

[45] Date of Patent: Mar. 23, 1993

[54] CYLINDER HEAD

[75] Inventors: Robert L. Jacques, Troy; James E. Foss; Scott K. Wilson, both of Lake Orion, all of Mich.

[73] Assignee: General Motors Corporation, Detroit, Mich.

[21] Appl. No.: 773,339

[22] Filed: Oct. 8, 1991

[51] Int. Cl.[5] ..... F01M 9/10

[52] U.S. Cl. ..... 123/90.33; 123/90.38; 123/196 M

[58] Field of Search ..... 123/90.33, 90.34, 90.38, 123/196 M

[56] References Cited

U.S. PATENT DOCUMENTS

| | | | |
|---|---|---|---|
| 4,709,667 | 12/1987 | Ichihara et al. | 123/90.38 |
| 4,729,349 | 3/1988 | Sonoda et al. | 123/90.34 |
| 4,883,027 | 11/1989 | Oikawa et al. | 123/90.33 |
| 5,027,762 | 7/1991 | Tokuyama et al. | 123/90.34 |
| 5,031,586 | 7/1991 | Masuda et al. | 123/196 M |

FOREIGN PATENT DOCUMENTS

| | | | |
|---|---|---|---|
| 126012 | 7/1984 | Japan | 123/90.34 |
| 138306 | 5/1989 | Japan | 123/90.34 |
| 123217 | 5/1990 | Japan | 123/90.33 |

*Primary Examiner*—E. Rollins Cross
*Assistant Examiner*—Weilun Lo
*Attorney, Agent, or Firm*—Gordon F. Belcher

[57] ABSTRACT

A cylinder head for supporting and lubricating hydraulic valve lifters comprises a head member having a deck face adapted for mating with an engine block. The head member has a bottom face which is approximately perpendicular to the deck face. A plurality of sockets are formed in the head member and are adapted to receive a hydraulic valve lifter. A one-way gallery is formed in the head member above the sockets. The one-way gallery is parallel to a horizontal plane of the engine block when the head member is mated therewith. The one-way gallery is adapted to communicate with the valve lifters. A one-way passage is formed in the head member. The one-way passage has a gallery end which communicates with the one-way gallery and a supply end which is above the gallery end. A supply passage is formed in the head member. The supply passage has one end which communicates with the supply end and another end which communicates with a block port in the mating face. The block port is below the one-way gallery. The block port registers with a fluid passage in the engine block which can contain pressurized fluid.

3 Claims, 2 Drawing Sheets

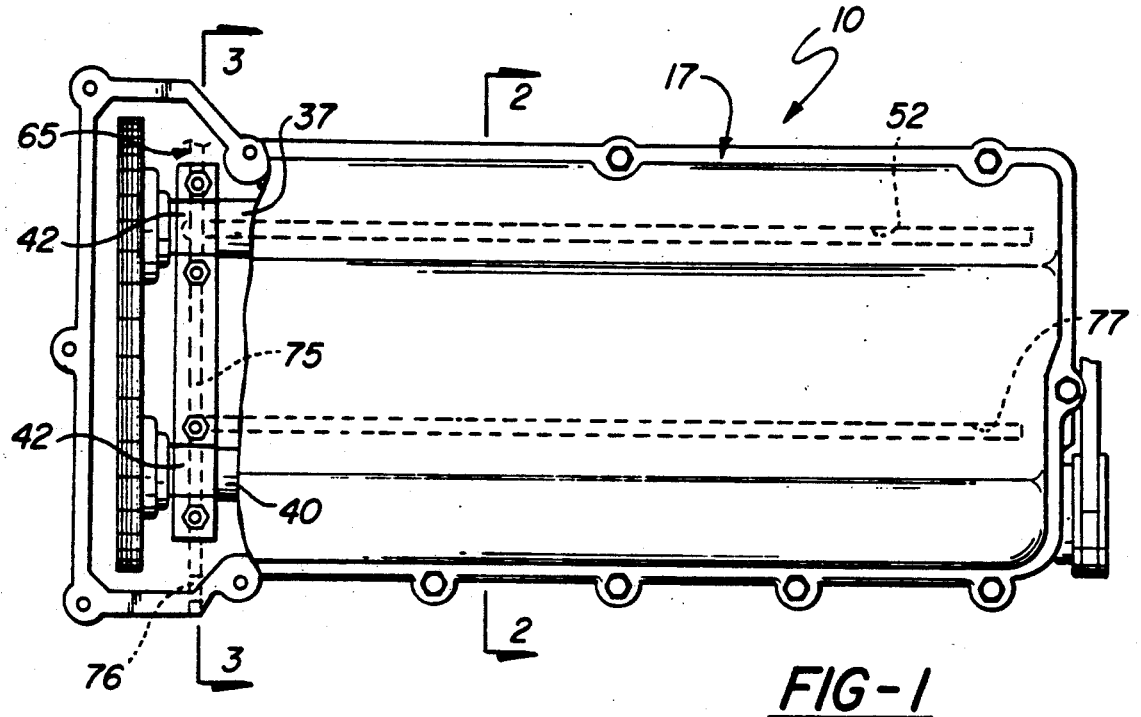
FIG-1
FIG-2
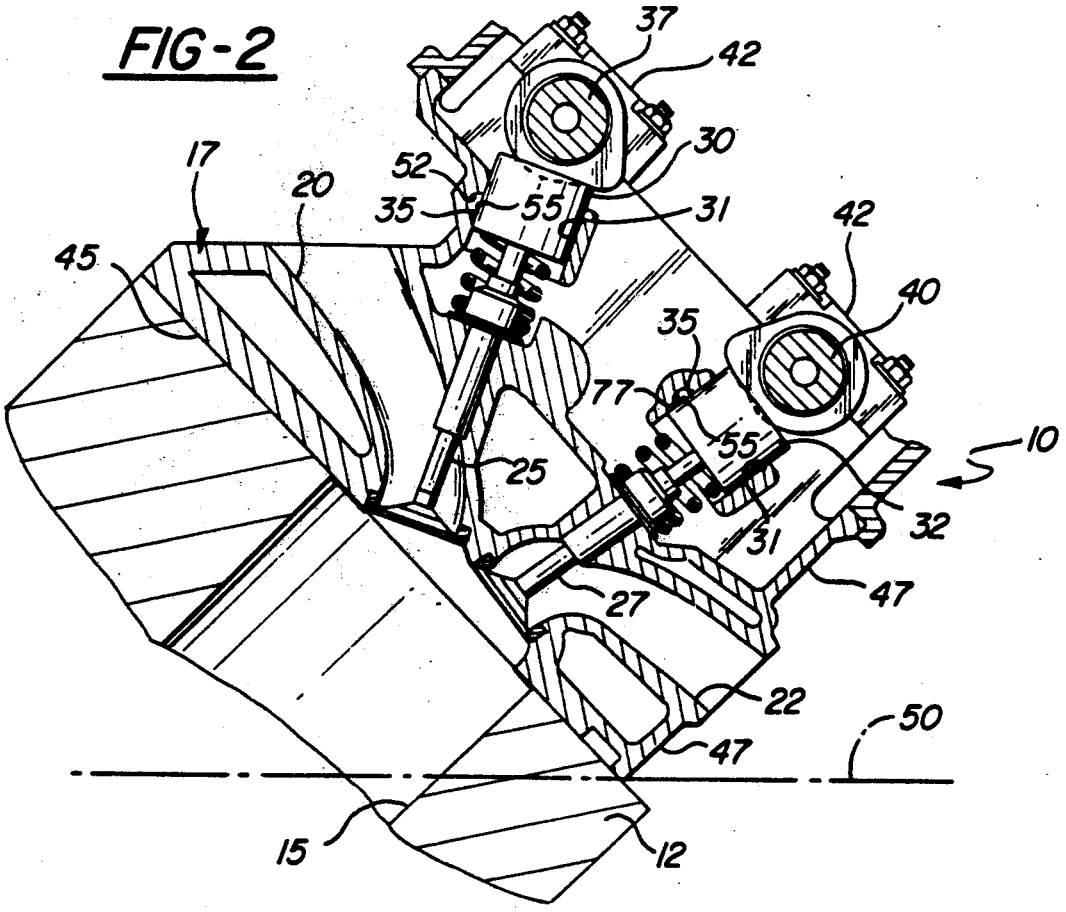

CYLINDER HEAD

TECHNICAL FIELD

This invention relates to a cylinder head for supporting and lubricating hydraulic valve lifters, and more particularly to a horizontal one-way gallery and an one-way passage which supply oil to the valve lifters and are oriented to obstruct oil flow out of the valve lifters into the one-way gallery when the engine is shut down.

BACKGROUND

Oil is typically supplied to hydraulic valve lifters through conduits in the cylinder head. Oil can drain out of each valve lifter between the valve lifter body and plunger into these conduits (i.e., back-flow) during engine shutdown. If, during engine shutdown, a sufficient amount of oil drains out of the valve lifters and out of the conduits (thereby limiting the amount of oil which can be instantaneously supplied to the valve lifters), noise can result during start-up of the engine. Pressure regulators or check valves can be used to obstruct back-flow of the oil out of the valve lifters and conduits during engine shutdown.

SUMMARY OF THE INVENTION

The present invention provides a cylinder head for supporting lubricating hydraulic valve lifters. The cylinder head comprises a head member having a deck face adapted for mating with an engine block. The head member has a bottom face which is approximately perpendicular to the deck face. A plurality of sockets are formed in the head member and are adapted to receive a hydraulic valve lifter. A one-way gallery is formed in the head member above the sockets. The one-way gallery is parallel to a horizontal plane of the engine block when the head member is mated therewith. The one-way gallery is adapted to communicate with the valve lifters. A one-way passage is formed in the head member. The one-way passage has a gallery end which communicate with the one-way gallery and a supply end which is above the gallery end. A supply passage is formed in the head member. The supply passage has one end which communicates with the supply end and another end which communicates with a block port in the mating face. The block port is below the one-way gallery. The block port registers with a fluid passage in the engine block which can contain pressurized fluid.

The fluid passage in the engine block can become depressurized during engine shutdown. Oil can thereby drain from the supply passage. The oil does not drain out of the one-way gallery through the supply passage since such oil must flow upward against gravity through the one-way passage in order to so drain out of the one-way gallery. Thus, the one-way gallery continues to contain oil thereby obstructing back-flow of oil out of the intake valve lifters. This reduces or eliminates the number of pressure regulators or check valves required to obstruct such back-flow. It also results in a reduction of the noise which can result during start-up of the engine if oil has drained out of the intake valve lifters during engine shutdown.

BRIEF DRAWING DESCRIPTION

In the drawings:

FIG. 1 is a plan view of the cylinder head of the present invention;

FIG. 2 is sectional elevational view of the cylinder head of FIG. 1 generally in the plane indicated by line 2—2 of FIG. 1 showing the camshafts and camshaft bearing caps assembled to the cylinder head; and FIG. 3 is a sectional elevational view of the cylinder head of FIG. 1 generally in the plane indicated by line 3—3 of FIG. 1 showing the one-way gallery, one-way passage and supply passage, with the camshafts and camshaft bearing caps assembled to the cylinder head.

Corresponding reference characters indicate corresponding parts throughout the several views of the drawings.

DETAILED DESCRIPTION

Figure 3:
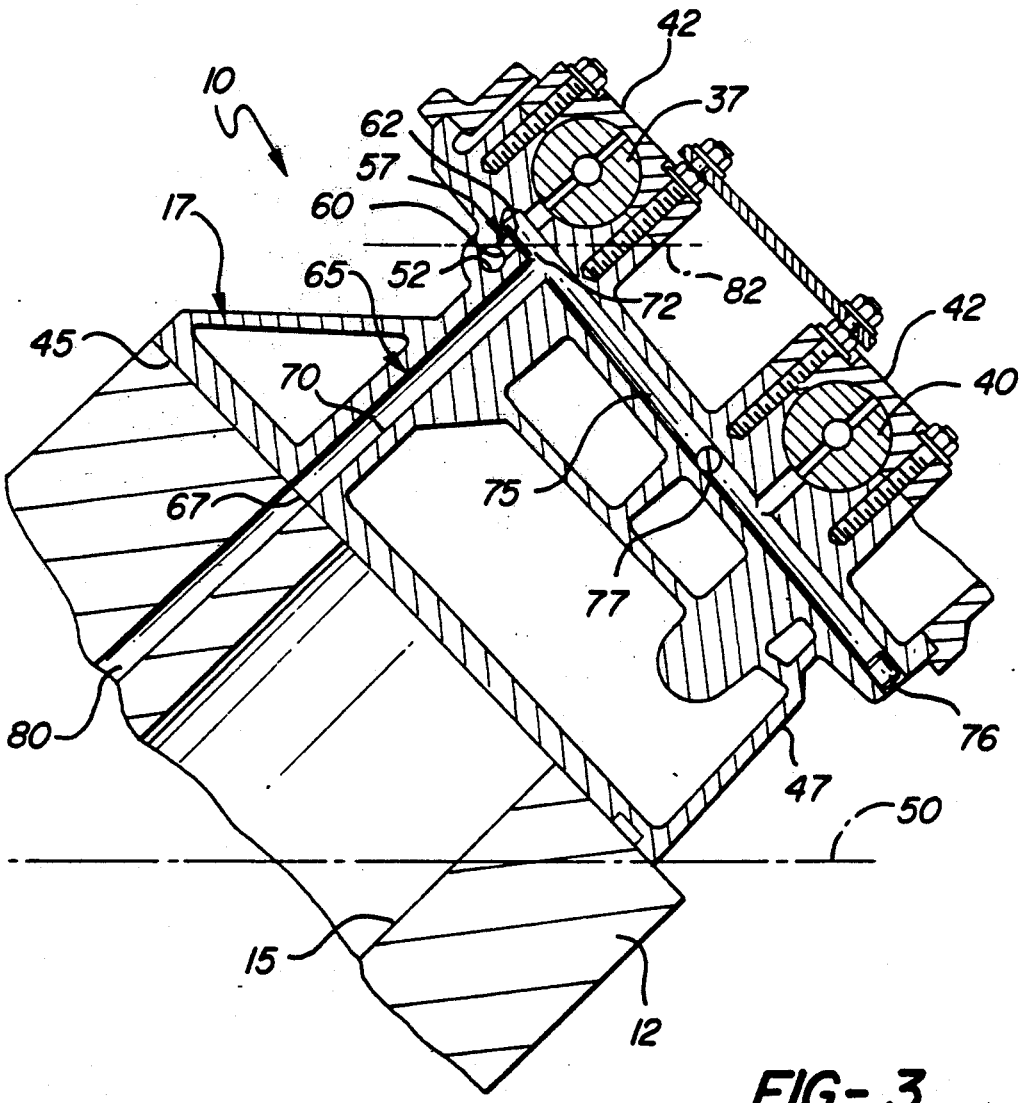

Referring to the drawings, and in particular, FIGS. 1 and 2, numeral 10 generally refers to a cylinder head of the present invention mounted on a cylinder block 12. The cylinder block 12 has a plurality of cylinder bores 15 arranged in one or more rows. Each row of cylinder bores 15 is covered by a single cylinder head 10. FIG. 2 shows one of the cylinder bores 15 in a direction which is parallel to the row of cylinder bores in which the shown cylinder bore is contained. A piston is disposed in each cylinder bore 15.

Each cylinder head 10 comprises a head member 17 as shown in FIG. 2. Intake and exhaust passages 20,22 are formed in the head member 17. The intake passage 20 leads to the cylinder bore 15 and exhaust passage 22 leads away from the cylinder bore 15. An intake valve 25 is seated in the end of intake passage 20 which adjoins the cylinder bore 15. An exhaust valve 27 is seated in the end of the exhaust passage 22 which adjoins the cylinder bore 15.

Individual sockets 31 are formed in the head member 17 above the end of the stem of each intake and exhaust valve 25,27. A hydraulic intake valve lifter 30 is received in each socket 31 which is above the stem of each intake valve 25. A hydraulic intake valve lifter 30 rests on top of the stem of each intake valve 25. A hydraulic exhaust valve lifter 32 is received in each socket 31 which is above the stem of each exhaust valve 27. Each hydraulic exhaust valve lifter 32 rests on the top of the stem of an exhaust valve 27. Each of the sockets 31 has a socket port 35 which is adapted to communicate with the valve lifter 30,32 received in the socket.

Intake and exhaust camshafts 37,40 are rotatably supported above the intake and exhaust valve lifters 30,32, respectively, so that their cam loads rest on the valve lifters. Each of the camshafts 37,40 has a passage formed therein which coincides with the longitudinal axis of the camshaft. Powder metal camshaft bearing caps 42 are bolted to the head member 17 to secure the camshafts 37,40 to the head member.

The head member 17 has a deck face 45 which is adapted for mating with the cylinder block 12 enabling the head member 17 to be mounted thereon. The head member 17 also has a bottom face 47 which is approximately perpendicular to the deck face 45. The deck face 45 forms an acute angle with a horizontal plane 50 of the cylinder block 12 when mated therewith.

A one-way gallery 52 is formed in the head member 17 above the sockets 31. The one-way gallery 52 is parallel to the horizontal plane 50 when the head member 17 is mated with the cylinder block 12. The one-way gallery 52 has a plurality of gallery ports 55. Each of the gallery ports 55 communicates with a separate individual socket port 35.

A one-way passage 57 is formed in the head member 17 and is perpendicular to the deck face 45. The one-way passage 57 has a gallery end 60 which communicates with the one-way gallery 52, and a supply end 62 which is above the gallery end 60.

The head member 17 also has a supply passage 65 formed therein. The supply passage 65 has one end which communicates with the supply end 62 and an d opposite end which constitutes a block port 67. The block port 67 registers with an opening in the deck face 45 and is below the one-way gallery 52. The distribution portion 72 of the supply passage 65 extends away from the supply end 62 toward the bottom face 47. The supply passage 65 has a supply portion 70 which is perpendicular to the deck face 45 and registers with the block port 67. The supply passage 65 also has a distribution portion 72 between the supply portion 70 and the one-way passage 57.

A single passage extends from the distribution portion 72 to the intake camshaft 37 enabling communication between the distribution portion 72 and the passage in the intake camshaft which coincides with its longitudinal axis. The single passage which extends from the distribution portion 72 to the intake camshaft 37 can be drilled from above with the intake camshaft 37 removed. Distribution portion 72 forms a four degree angle with the deck face 45.

A distribution passage 75 extends away from the distribution portion 72 to the bottom face 47 where it is plugged. The distribution passage 75 communicates with the distribution portion 72 and is coaxial therewith. The distribution passage 75 intersects an exhaust lifter gallery 77 which communicates with the exhaust valve lifters 32.

A single passage extends from the distribution passage 75 to the exhaust camshaft 40 to enable communication between the distribution passage 75 and the passage which extends through the exhaust camshaft 40 and coincides with its axis. The single passage which extends from the distribution passage 75 to the exhaust camshaft 40 can be drilled from above with the exhaust camshaft 40 removed.

The block port 67 registers with a block passage 80 which is formed in the cylinder block 12. During engine operation, the block passage 80 contains pressurized oil enabling oil to flow through the supply portion 70 and branch into the distribution portion 72 and the distribution passage 75. The oil in the distribution portion 72 flows into the one-way passage 57 into the one-way gallery 52. The oil in the one-way gallery 52 is distributed through the gallery ports 55 and socket ports 35 to the intake valve lifters 30. A portion of the oil in the distribution portion 72 flows upward into the passage in the intake camshaft 37 which coincides with its longitudinal axis.

The oil in the distribution passage 75 flows down to the plugged end 76 and then fills up the exhaust lifter gallery 77. Oil in the exhaust lifter gallery 77 is distributed to the exhaust valve lifters 32. A portion of the oil in the distribution passage 75 flows upward into the passage in the exhaust camshaft 40 which coincides with its longitudinal axis.

The block passage 80 can become depressurized during engine shutdown. Oil can thereby drain from the supply portion 70 through the block passage 80. The resulting oil level in the one-way passage 57 is shown by the reference numeral 82 in FIG. 3. The oil does not drain out of the one-way gallery 52 through the supply portion 70 since such oil must flow upward against gravity through the one-way passage 57 in order to so drain out of the one-way gallery. Thus, the one-way gallery 52 continues to contain il thereby obstructing back-flow of oil out of the intake valve lifters 30. This reduces the number of pressure regulators or check valves required to obstruct such back-flow. It also results in a reduction of the noise which can result during start-up of the engine if oil has drained out of the intake valve lifters 30 during engine shutdown.

Draining of the supply portion 70 does not cause the exhaust lifter gallery 77 to drain through the distribution passage 75 since oil in the exhaust lifter gallery must flow upward through the distribution passage in order to reach the supply portion 70. Thus, the exhaust lifter gallery 77 continues to contain oil thereby obstructing back-flow of oil out of the exhaust valve lifters 32.

During engine shutdown, the powder metal camshaft bearing caps 42 retain oil. This facilitates lubrication of the bearings which support the intake and exhaust camshafts 37,40 when the engine is started after shutdown.

The elevated position of the distribution portion 72 and the location of the intake camshaft 37 above the distribution portion results in air which might accumulate in the passages during shutdown flowing upward to the distribution portion and accumulating therein. Air in the distribution portion 72 flows upward into the passage in the intake camshaft 37 which coincides with its longitudinal axis and is vented therefrom. This reduces the likelihood of air accumulating in the intake and exhaust valve lifters 30,32 during engine shutdowns.

While the invention has been described by reference to certain preferred embodiments, it should be understood that numerous changes could be made within the spirit and scope of the inventive concepts described. Accordingly, it is intended that the invention not be limited to the disclosed embodiments, but that it have the full scope permitted by the language of the following claims.

The embodiments of the invention in which an exclusive property or privilege is claimed are defined as follows:

1. A cylinder head for supporting and lubricating hydraulic valve lifters comprising:

a head member having a deck face adapted for mating with an engine block enabling said head member to be mounted thereon, said head member having a bottom face which is generally perpendicular to said deck face, said deck face forming an acute angle with a horizontal plane of the engine block when mated therewith;

a plurality of sockets formed in said head member, each of said sockets being adapted to receive a hydraulic valve lifter, each of said sockets having a socket port being adapted to communicate with a valve lifter received therein;

a one-way gallery formed in said head member above said sockets, said one-way gallery being parallel to a horizontal plane of the engine block when said head member is mated therewith, said one-way gallery having a plurality of gallery ports, each of said gallery ports being adapted to communicate with one of said socket ports;

a one-way passage formed in said head member, said one-way passage having a gallery end communicating with said one-way gallery and a supply end which is above said gallery end;

said one-way passage be.ng perpendicular to said deck face; and a supply passage formed entirely in said head member, said supply passage having one end communicating with said supply end and another end communicating with a block port formed in said deck face, said block port being below said one-way gallery, said supply passage extending away from said supply end toward said deck face;

said supply passage having a supply portion in registry with said block port, said supply portion being perpendicular to said deck face, said supply passage further having a distribution portion between said supply portion and said one-way passage;

said block port registering with a fluid passage in the engine block so that, when said fluid passage contains pressurized fluid, the fluid can flow through said supply passage and one-way passage into said one-way gallery, the fluid in said one-way gallery being distributed through said gallery ports and socket ports to the valve lifters.

2. A cylinder head as set forth in claim 1 wherein said distribution portion forms a 4 degree angle with the plane of said deck face.

3. A cylinder head as set forth in claim 1 and further comprising a distribution passage communicating with said distribution portion and being coaxial therewith, said distribution passage extending away from said distribution portion toward said bottom face and communicating with an additional valve lifter.

* * * * *